United States Patent [19]

Holt

[11] Patent Number: 4,510,781

[45] Date of Patent: Apr. 16, 1985

[54] RING ROLLING

[75] Inventor: Peter J. Holt, Cheltenham, England

[73] Assignee: Formflo Limited, Cheltenham, England

[21] Appl. No.: 517,025

[22] Filed: Jul. 25, 1983

[30] Foreign Application Priority Data

Jul. 31, 1982 [GB] United Kingdom ..... 8222149

[51] Int. Cl.[3] ..... B21D 15/04

[52] U.S. Cl. ..... 72/105; 72/91

[58] Field of Search ..... 72/91, 105, 106, 110

[56] References Cited

U.S. PATENT DOCUMENTS 4,339,937 7/1982 Strugala et al. ..... 72/105

FOREIGN PATENT DOCUMENTS 204309 10/1967 U.S.S.R. ..... 72/105

*Primary Examiner*—Lowell A. Larson

*Assistant Examiner*—Jorji M. Griffin

*Attorney, Agent, or Firm*—Scully, Scott, Murphy & Presser

[57] ABSTRACT

A ring rolling machine for cold rolling bearing cages and the like has a working station (32) at which the rolling operation is performed on an annular blank by an annular die (80,82) co-operating with a mandrel (50). The die is held coaxially in a die housing (74) mounted rotatably in one of two through openings (62,64) in a shuttle (42) which is reciprocated between the working station and two alternate transfer stations (28,30) at which the front die insert (82) is ejected with the rolled ring and re-inserted with a fresh blank. The die housing projects through a slot (70) in the shuttle to engage the die drive roll (78), and via the die transmits rotation derived from the drive roll to the mandrel and a pair of mandrel support rolls (110) which apply radial force to the mandrel. The mandrel support rolls are mounted in a head on a shaft pre-tensioned to control their axial position without fasteners; they also control the axial positions of the die and mandrel.

17 Claims, 18 Drawing Figures

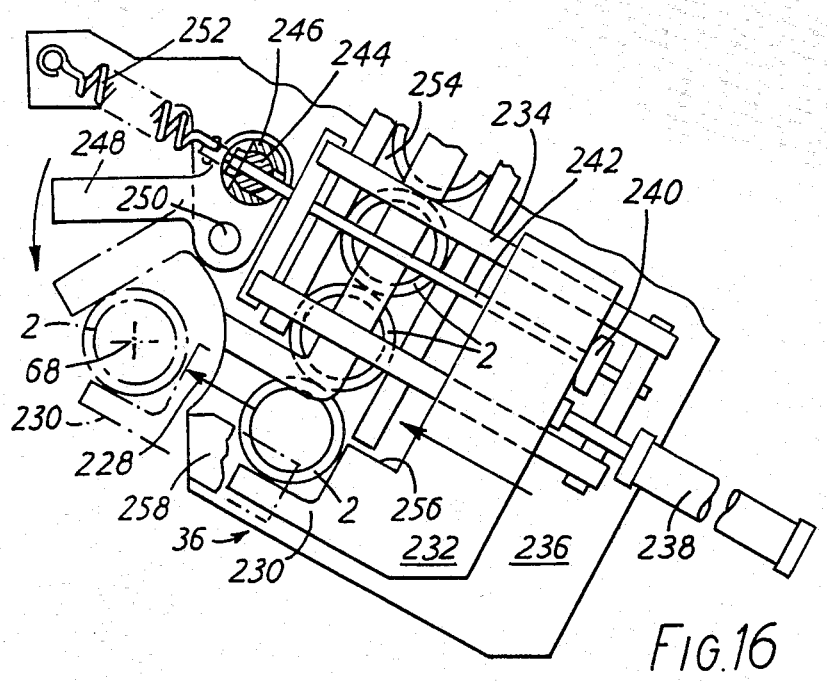
FIG. 16
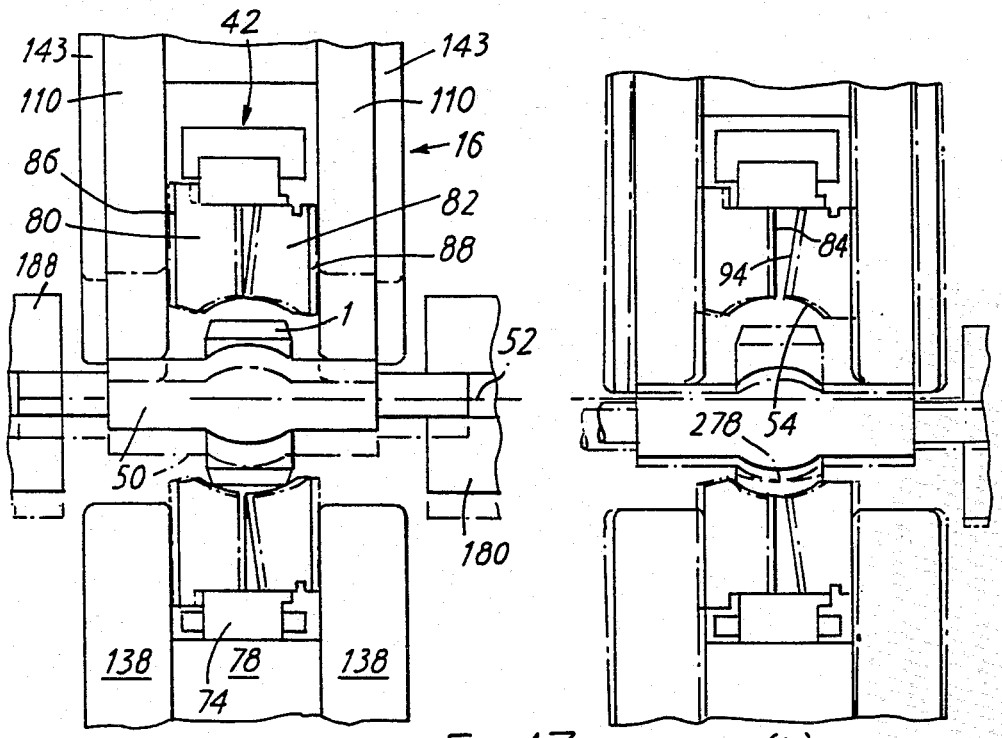
(a) FIG. 17 (b)

RING ROLLING

FIELD OF THE INVENTION

This invention relates to apparatus and methods for forming rings to a predetermined profile from a succession of annular blanks by cold rolling the blank, the apparatus being of the kind having an annular die, a mandrel for co-operating with the annular die, die drive means for rotating the die about the axis of the die, and force-applying means for applying a radial force to the mandrel when the mandrel extends through the die with the annular blank surrounding the mandrel and surrounded by the die, so as to squeeze the blank along an axial cross-section thereof to one side of the axis of the blank but not the other, the apparatus comprising means for rotating the mandrel whereby the said radial force causes the section of the blank so squeezed to be deformed to conform with an internal profile of the die and an external profile of the mandrel. Such apparatus will be referred to as "ring rolling apparatus of the kind hereinbefore specified".

Similarly, a method for forming rings to a predetermined profile from a succession of annular blanks by cold rolling will be referred to as "a method of ring rolling of the kind hereinbefore specified", when the method comprises squeezing an axial cross-section of the annular blank, to one side of the axis of the blank but not the other, between a rotating mandrel and a rotating annular die, with the mandrel extending through the die so that the blank surrounds the mandrel and is surrounded by the die, the squeezing of the said section of the blank being effected by applying an appropriate radial force to the mandrel whereby the squeezed section is deformed to conform with an internal profile of the die and an external profile of the mandrel.

BACKGROUND ART

U. K. patent specification No. 1,329,251 (now assigned to the proprietors of the present Application) describes a ring rolling method and apparatus in which the ring is formed with a profile by contact of the annular blank with a plurality of external rolls, such that each of the latter has its axis of rotation on the opposite side of the point of contact of the roll with the blank from the axis of the blank. The same specification also describes a second embodiment, for forming a profiled bore of a ring, in which the latter is rolled between a profiled mandrel and a roll in the form of a ring which surrounds the annular blank or workpiece, i.e. the axes of this roll and of the blank itself are on the same side of the point of contact between the roll and the blank.

These two embodiments typify what may be called "open" and "closed" ring rolling methods, respectively, a "closed" system being characterized essentially by the mandrel and by the ring-like forming roll which is conventionally referred to—and is so called herein—as a die. A method or apparatus of the kind hereinbefore specified relates to a "closed" system of ring rolling.

Further examples of closed systems are described in our U.K. patent specifications Nos. 1,395,726 and 1,475,780. In the first of these, the use of a radially-split die is taught. The die comprises a fixed rear die insert and a front die insert which is secured to a loading and unloading head reciprocable axially by a hydraulic actuator. By contrast, in specification No. 1,475,780, the die is unitary instead of being split; instead it is the mandrel that is radially split. It will be understood that in a "closed" system, it may be necessary to provide either a split die or a split mandrel in order to release the rolled ring from the tooling, whether it is the outer circumference or the bore, or both which is or are profiled to a non-cylindrical form.

In all of the prior art known to us, each fresh blank is fed axially into position for the cold rolling operation, and the tooling is then engaged with it in that position; after completion of the operation, the tooling is disengaged and the rolled ring is then withdrawn axially, after which the next blank is inserted. During each period of removal and insertion, the tooling is of course idle, and this imposes limitations on the rate at which rolled rings can be produced in the machine. In addition, there are design and operational problems associated with the need to provide a mandrel having a significantly large unsupported length. An important feature of all of the prior art known to us is that, since it is necessary to provide radial support for the workpiece, the number of axes for the various rolling tools must be at least three. In some systems there is a multiplicity of rolls, each with its associated shafting, bearings etc.

DISCUSSION OF THE INVENTION

According to the invention, in a first aspect, ring rolling apparatus of the kind hereinbefore specified includes a shuttle having a through opening for accommodating the die, the shuttle being movable so as to transfer the through opening between a working station at which the mandrel, the die drive means and the force-applying means are situated, and at least one transfer station for removal of the rolled ring and insertion of a fresh blank, the shuttle being adapted to cause the die drive means to be in operative engagement with the die when the latter is at the working station.

In preferred embodiments an annular die housing is mounted rotatably in the through opening, whereby the latter constitutes the female element of a bearing, the through opening being in the form of an incomplete circle to define a slot in one face of the shuttle through which the die housing projects to engage the die drive means.

The force-applying means preferably comprises a head including a pair of mandrel support rolls, axially spaced apart on a common axis and mounted in a force-transmitting housing of the head, the head being reciprocable in a plane containing the mandrel axis so that the mandrel support rolls transmit the radial force directly to the mandrel itself.

The provision of a shuttle, adapted to support the die so that it can be driven in rotation whilst mounted in the shuttle, enables the machine to be in several important respects particularly compact. In particular, there need only be two roll axes external to the shuttle, viz. that of the mandrel support rolls and that of a second roll (or group of rolls on a common axis) on the opposite side of the shuttle so as to take the radial reaction force. The reaction rolls, which are preferably also the die drive means, have their axis in a common plane with the axes of the shuttle aperture, mandrel, workpiece and the mandrel support rolls. All of this enables the construction of the machine to be very considerably simplified. In addition, the unsupported length of the mandrel is able to be reduced to a minimum, thus minimising the bending moment applied to the mandrel by the force-applying means.

The mandrel is preferably mounted so that its axis is capable of limited axial movement under the influence of the applied force. Because the mandrel length is minimised, so also is the axial length of the mandrel support roll assembly.

In addition, because the die housing is carried by the shuttle independently of the mandrel support rolls, so that the latter straddle the die housing system, the provision of two support spindles is avoided.

However, in preferred embodiments of the invention, the mandrel support rolls not only support and axially locate the mandrel, but are also adapted to effect positive axial location of the dies themselves, thus maintaining the rolling tract automatically in correct relationship to the centre lines and ensuring a stress distribution during the rolling operation that shows a symmetrical pattern about the axial centre plane of the die and workpiece.

The mandrel support rolls are preferably mounted on a common shaft of the head, the head including means for maintaining the shaft in tension and for transmitting a resultant compressive, axial reactive force to the support rolls whereby to tend to maintain the axial spacing between the two support rolls at a predetermined value.

The head preferably also includes spacer means for limiting, to a predetermined minimum value, the axial distance between the mandrel support rolls. During the ring rolling operation, the support rolls are capable of limited axial movement away from each other, as may be necessary to allow the two parts of the die to move axially apart. Such variation in the axial spacing between the support rolls is effected by the die itself, under the influence of the applied radial force, and is controlled by the continuously-maintained reaction force resulting from the tensile axial force applied to the mandrel support roll shaft.

It is not necessary, with the above arrangement, to provide fasteners to secure the mandrel support rolls together; this in turn avoids stress-raising holes through the latter for accommodating fasteners.

According to the invention, in a second aspect, in a method of ring rolling of the kind hereinbefore specified, the annular blank is loaded into a shuttle at a transfer station; the shuttle is moved so as to bring the blank, carried within the die which is itself mounted within the shuttle, to a working station remote from the transfer station; the die is rotated in the shuttle at the working station with the mandrel extending through the die and blank, whilst the said radial force is applied so as to form the blank into a rolled ring of the required profile; the shuttle is subsequently moved so as to carry the rolled ring to a transfer station; the ring is there removed from the shuttle and a fresh annular blank inserted; and the shuttle is again moved so as to bring the fresh blank to the working station.

What takes place at the transfer station, where the die is split, and in preferred embodiments, is that one of the two parts (referred to hereinafter as die inserts) of the die is withdrawn by a loader which in this case takes the form of a die insert loader. In this operation the die insert loader co-operates with an ejector device, whereby the rolled ring is removed with the front die insert. The rolled ring is taken away, and a new annular blank is then presented over the entrance to the opening through the shuttle, by means of a blank loading device (or "blank loader"). The blank loader holds the blank positively at all times until the die insert loader reinserts the die insert into the shuttle by advancing it axially, with the blank being pushed forward by the die insert itself, into the through opening. The die insert loader, here again, co-operates with the ejector device, so that the blank is at all times positively held. The complete die, with its fresh blank, has now been reassembled in the shuttle; and upon withdrawal of the appropriate portions of the die insert loader and ejector device, the shuttle is free to carry the new blank to the working station.

The machine preferably has two transfer stations with a working station between them, the shuttle being arranged to move so that when each ring is being rolled, its predecessor is being unloaded at one transfer station and the blank for the next ring is being loaded. In this way ample time can be allowed for the loading and unloading operations with minimal lapse of time between each rolling operation and the next.

An embodiment of the invention, being a ring rolling machine will with its method of operation now be described, by way of example only, with reference to the accompanying drawings.

BRIEF DESCRIPTION OF THE DRAWINGS

FIG. 16 is a greatly-simplified elevation, seen from the front of the machine and showing part of a blank loader for loading the cylindrical blanks into the machine, the blank loader being one of two such loaders of the machine, viz. the right-hand one indicated in FIG. 6;

FIG. 17 is in two parts, viz. (a) and (b), each of which is a diagrammatic view generally similar to FIG. 12 but illustrating the ring rolling operation itself.

SPECIFIC DESCRIPTION

Figure 1:
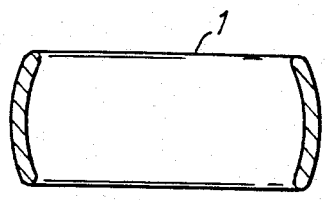
FIG. 1 is a diametral section, taken on the line I—I in FIG. 2, of a cage ring of a constant-velocity universal joint, made by cold-rolling a cylindrical, annular, blank in the ring rolling machine.
Figure 2:
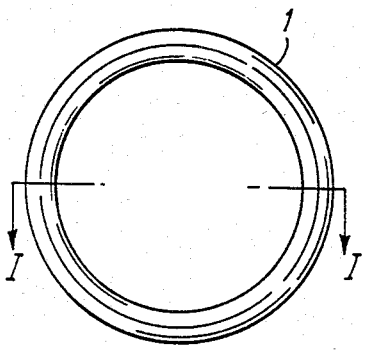
FIG. 2 is an elevation of the cage ring.
Figure 3:
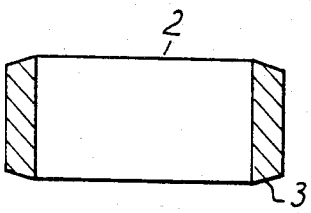
FIG. 3 is a diametral section of the cylindrical blank, taken on the line III—III in FIG. 4.
Figure 4:
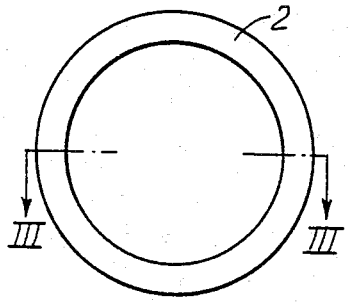
FIG. 4 is an elevation of the blank.

Referring first to FIGS. 1 to 4, the constant-velocity joint cage 1, shown in FIGS. 1 and 2, is seen in the form in which it finally leaves the ring rolling machine now to be described. This cage is but one example of the kind of ring that can be made using such a machine; outer races for rolling bearings are a typical example of other rings suitable for this method of manufacture. The annular blank 2, FIGS. 3 and 4, is formed by parting off a length of tubular steel stock, with formation of the chamfered end faces 3, and, if necessary, appropriate machining of the outer circumferential surface or of the bore, or both.

Figure 5:
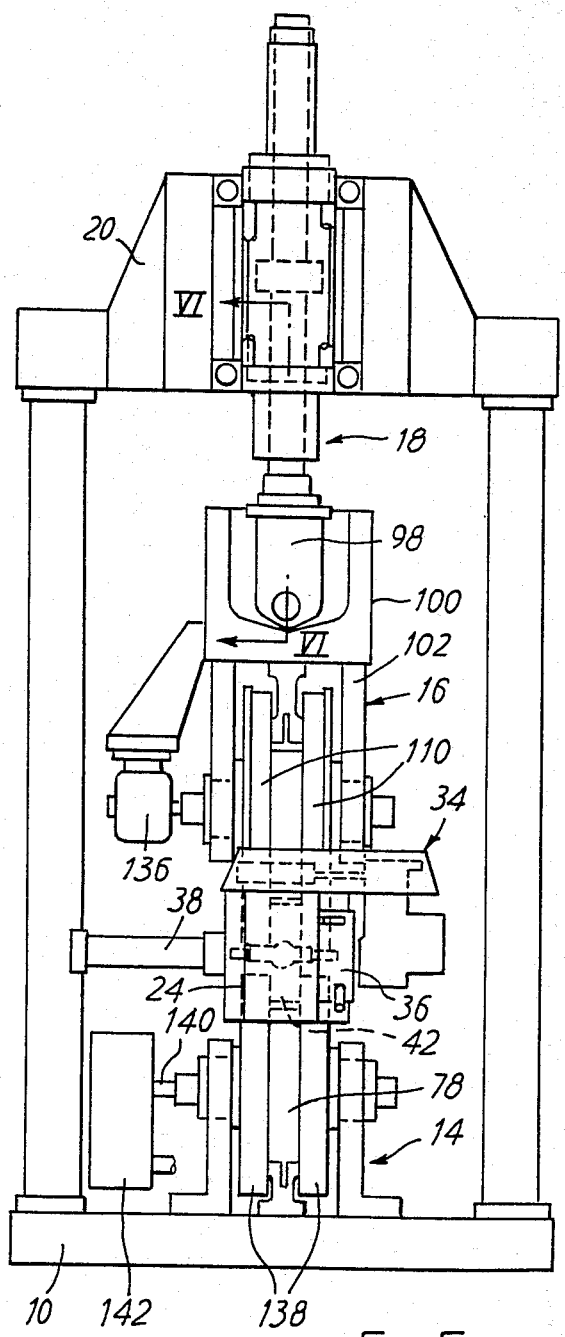
FIG. 5 is a much-simplified end elevation of the ring rolling machine, with the front of the machine on the right-hand side of the Figure.
Figure 6:
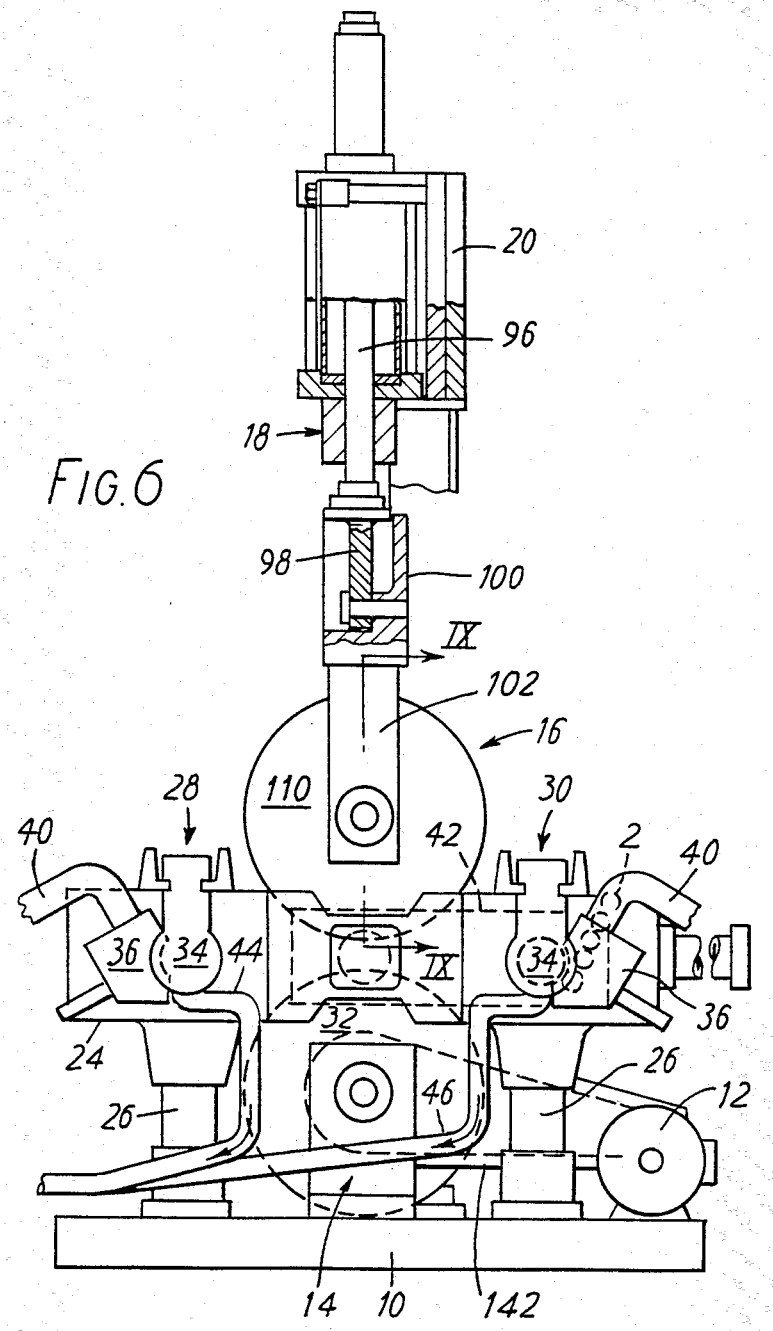
FIG. 6 is a much-simplified front elevation of the machine, taken partly in section on the line VI—VI in FIG. 5.

Reference will now be made to FIGS. 5 and 6 for a general description of the ring rolling machine. This essentially comprises a baseplate 10 upon which there are supported a main drive motor 12 (omitted from FIG. 5 for clarity), and three main assemblies of the machine, viz. a fixed head assembly 14 whose principal function is to transmit drive from the motor 12 to the rolling die and the other rotating parts of the machine; a moving head assembly which comprises a moving head 16 carried by a hydraulic ram unit 18, which in turn is mounted in an overhead frame 20 carried on the baseplate; and a transfer assembly 22.

The transfer assembly 22 comprises a hollow, generally-rectangular shuttle housing 24 extending horizontally below the moving head 16 and above the fixed head assembly 14. The shuttle housing 24 is mounted upon the baseplate 10 by means of a pair of heavy hydraulic jacks 26. The function of the jacks 26 is to prevent the full load, imposed by application of downward forces on components of the shuttle assembly in a manner to be described later herein, from being transmitted to the baseplate 10. For this purpose the jacks 26 are charged with hydraulic fluid from a source, not shown, at predetermined pressure. The jacks 26 are, for clarity, omitted from FIG. 5.

The shuttle housing 24 defines three operational stations, viz. a left-hand transfer station 28, a right-hand transfer station 30, and a working station 32. The working station 32 is midway between the two transfer stations, and both the fixed head assembly 14 and the moving head 16 are to be regarded as being situated at the working station.

At each of the two transfer stations 28 and 30, there are arranged adjacent the front of the shuttle housing 24 a die insert loader 34 and a blank loader 36. At the rear of the shuttle housing, again at each transfer station, there is mounted an ejector unit 38 in opposed relationship (as will be seen later) with the corresponding die insert loader 34 and blank loader 36.

In operation, respective blank feed runways 40 deliver the annular blanks 2 (FIGS. 3 and 4) to the blank loaders 36. The blank loader 36 at the left-hand transfer station 28 in co-operation with the die insert loader 34 and ejector unit 38 at the same station, inserts one blank into a shuttle 42 contained within the shuttle housing 24. The shuttle is then moved to the right, as seen in FIG. 6, carrying the blank to the working station 32 where a ring rolling operation is carried out, in a matter to be explained in detail hereinafter, to form the rolled cage 1 (FIGS. 1 and 2). Whilst this rolling operation is in progress, a second annular blank 2 is being inserted into the shuttle 42 at the right-hand transfer station 30, in precisely the same manner.

On completion of the rolling operation to form the first cage, the shuttle is moved to the left as seen in FIG. 6, thus transferring the first cage back to the left-hand transfer station and the second blank to the working station. Thereupon, the first cage is ejected from the shuttle by the ejector unit 38 in co-operation with the die insert loader 34, to be removed along a left-hand delivery runway 44. A third blank is then inserted into the shuttle at the left-hand transfer station 28 as before. Meanwhile, the second blank has been rolled to form a second cage 1, which is transferred to the right-hand transfer station 30, for ejection, and removal along a right-hand delivery runway 46, when the third blank is transferred to the working station 32.

The runways 40, 44, 46 are omitted from FIG. 5 for clarity.

Reference will now be made to FIGS. 7 to 12, which illustrate in greater detail various aspects of the three main assemblies of the ring rolling machine and its method of operation.

Figure 12:
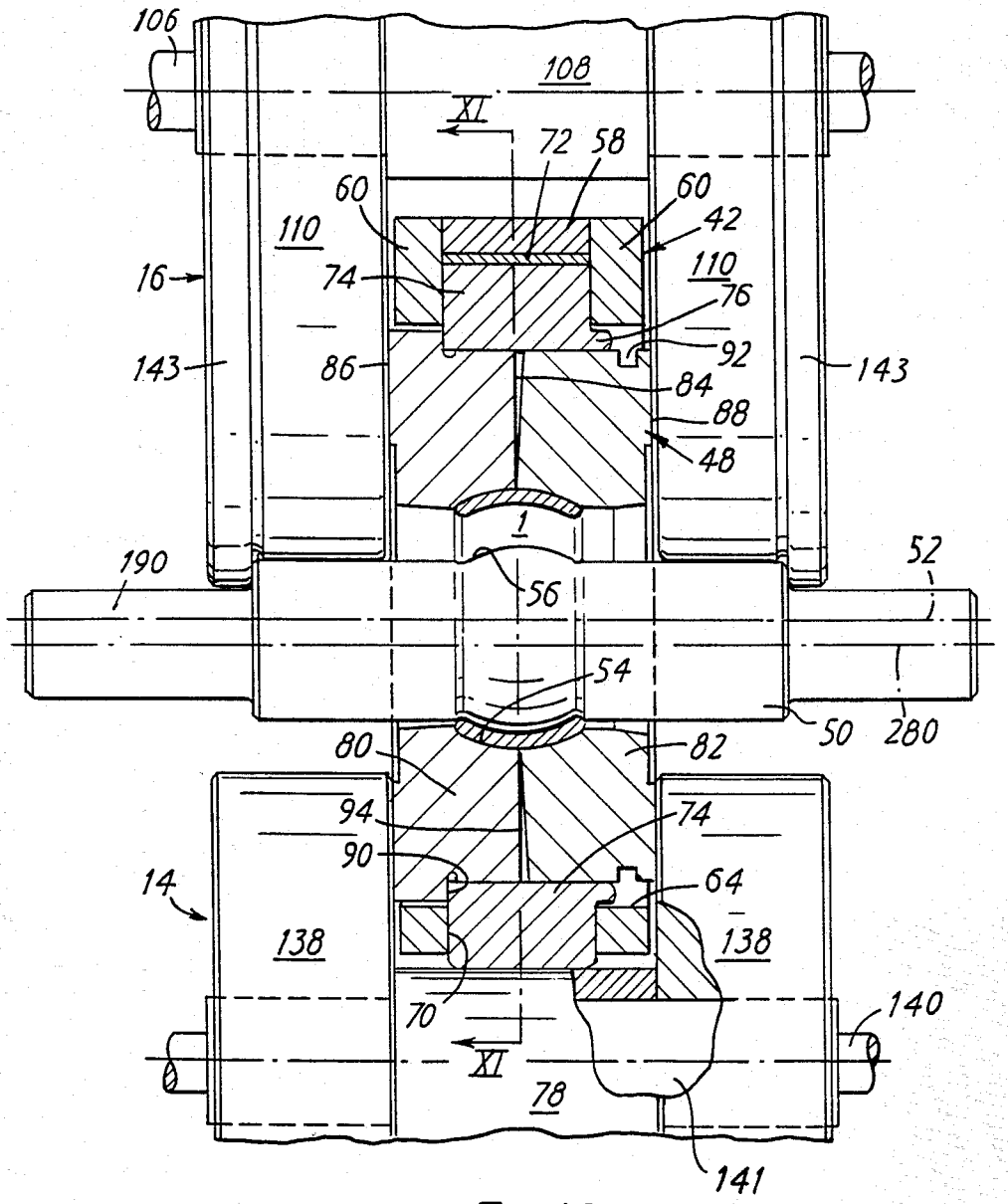
FIG. 12 is a partly-simplified, endwise elevation, taken partly in section on the transverse centre plane of the machine which contains the line IX—IX in FIG. 6, and illustrates the positional relationships between a workpiece and various components of the machine at the end of the ring rolling operation.

The cold-rolling operation itself is performed by rotating the annular blank 2 about its own axis within an annular die 48, FIG. 12, and squeezing, between the die 48 and a horizontal mandrel 50, the axial cross-section of the blank 2 which is to the lower side of the axis of the blank, whilst the mandrel 50 and die 48 are themselves each rotating about its own horizontal axis. The axis of the die 48 is indicated at 52 in FIG. 12. The squeezing action is effected by applying a vertically downward radial force to the mandrel 50 by means of the moving head 16; thus the cross-section of the blank being squeezed at any given instant is that lying in the common vertical diametral plane of the blank, die and mandrel below the die axis 52. Because the blank is undergoing rotation about its own axis, the whole of the blank is of course progressively squeezed so that the metal undergoes plastic flow conforming finally in its external peripheral surface with an internal profile 54 formed in the bore of the die 48, whilst its internal surface has a final profile conforming with an external profile 56 formed around the mandrel 50. It is in this final form that the blank—now no longer a blank but substantially a finished article—is seen in FIG. 12.

For the avoidance of confusion, the blank 2 at all stages after being positioned in the die ready to be deformed by cold rolling, will be referred to as the workpiece.

The construction of the shuttle 42 is as follows. It comprises a shuttle body of "sandwich" construction built up of a rectangular core plate 58 between a pair of rectangular side plates 60 which are firmly secured to the core plate 58. Two through openings, viz. a left-hand shuttle aperture 62 and a right-hand shuttle aperture 64, are formed in the shuttle body. Each shuttle aperture 62,64 has a horizontal axis, indicated respectively at 66 and 68 in FIG. 10. As can be seen from FIGS. 10 and 11, each shuttle aperture consists of a pair of axially-aligned holes in the respective plates 60, and a bore formed in the core plate 58. This bore of the core plate is of a radius greater than the vertical distance between its axis 66 or 68 and the bottom face of the core plate, whereas the radius of each of the holes through the plates 60 is less than such distance. As a result, it can be seen that each shuttle aperture 62,64 is open at the bottom over the width of the core plate, defining a slot 70.

Figures 10, 11:
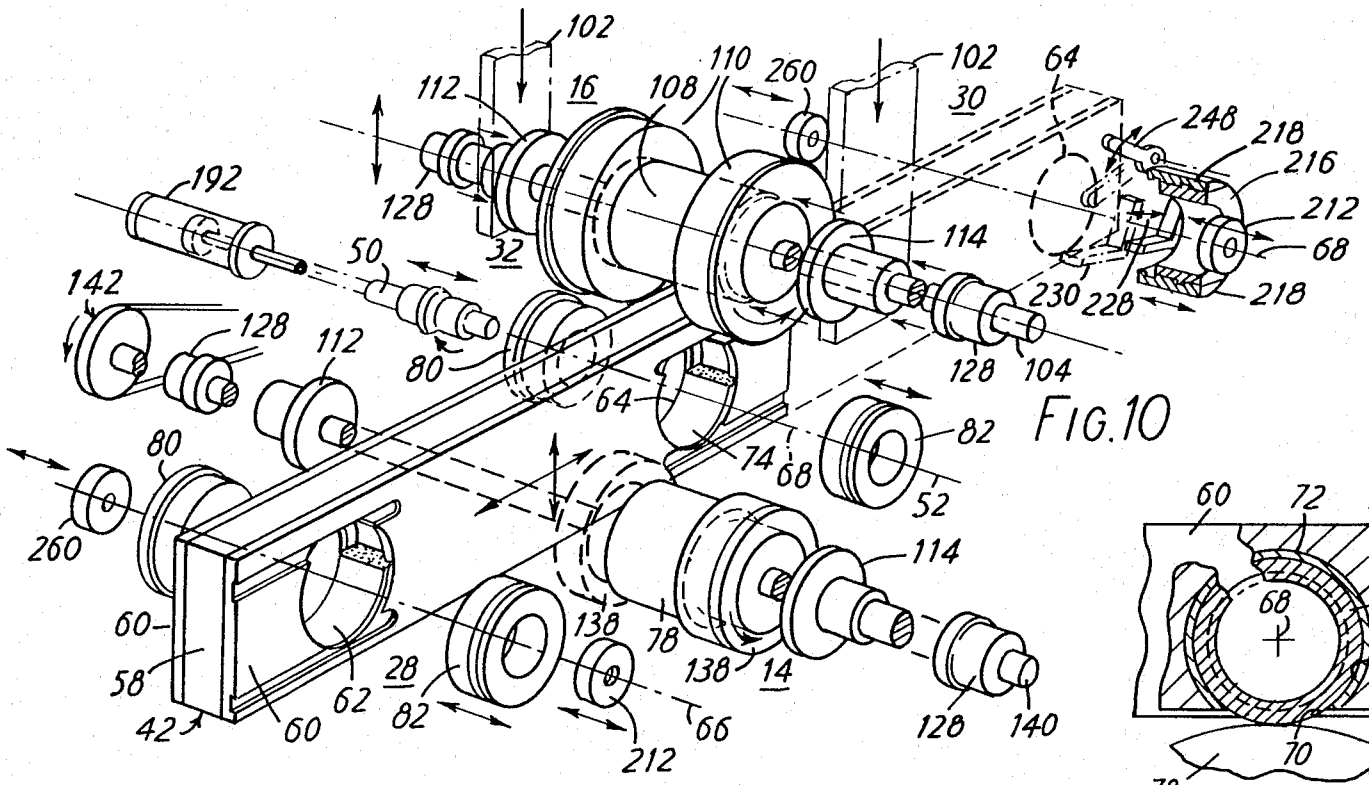
FIG. 10 is a diagrammatic, "exploded" view illustrating a shuttle of the machine and aspects of its relationship with various other components of the machine.
FIG. 11 is a scrap section, seen from the front and taken mainly in section on the line XI—XI in FIG. 12, and illustrates the manner in which a rotatable die housing is mounted in the shuttle so as to be driven during operation of the machine.

Secured to the core plate within each shuttle aperture is a die housing bearing sleeve 72, which, because the bore formed in the core plate is incomplete, is itself in the form of an incomplete cylinder as can be seen from FIG. 11.

A cylindrical die housing 74 is mounted coaxially in each bearing sleeve 72, for rotation in the latter. Each die housing 74 has at one end an axial flange 76, FIG. 12, which extends into the hole formed in the front side plate 60 of the shuttle. The die housing 74 protrudes through the slot 70, so that when the corresponding shuttle aperture 62 or 64 is at the working station 32 of the machine, the die housing 74 is engaged by a die drive roll 78 of the fixed head assembly 14. As will be seen later herein, it is by this means that rotational drive from the main motor 12 is transmitted to the various tooling components during the cold rolling operation, and of course to the workpiece itself.

The die 48 consists of two parts, viz. a rear die insert 80 (which can be made integral with the die housing 74 but which, in this example, is a separate component) and a front die insert 82. The rear die insert 80 has a front face 84 which is planar and lies approximately in the transverse centre plane of the shuttle core plate 72. Its rear face 86 is also planar, and accurately machined to this end, whilst the front face 88 of the front die insert is similarly machined so as to be truly planar. The rear die insert 80 has a shoulder 90 which bears against the die housing 74 to locate the die insert in the forward direction, i.e. towards the front of the machine; but the insert 80 can move rearwardly, whilst the circumferential outer surface of the front die insert 82 is cylindrical so that the insert 82 can move both forwardly and rearwardly with respect to the die housing 74. However, this cylindrical face of the front die insert has, just behind the front face 88, a peripheral groove 92 whose purpose will become apparent later herein. The shape of the rear face 94 of the front die insert 82 is not critical, but it is convenient to make it in generally frusto-conical form as shown in FIG. 12, thus ensuring that when the two die inserts are forced axially together, they meet in the bore of the die.

The hydraulic ram unit 18 (FIGS. 5 and 6) can be of any suitable kind and may be of conventional construction. Its ram 96 terminates at its lower end in a thrust head 98, which is pivoted to a thrust block 100. The moving head 16 comprises a yoke, consisting of the thrust block 100 and a pair of downwardly-depending, parallel yoke plates 102 secured to the block 100, and a rotatable assembly carried in bearings 104 in the yoke plates 102.

Figure 9:
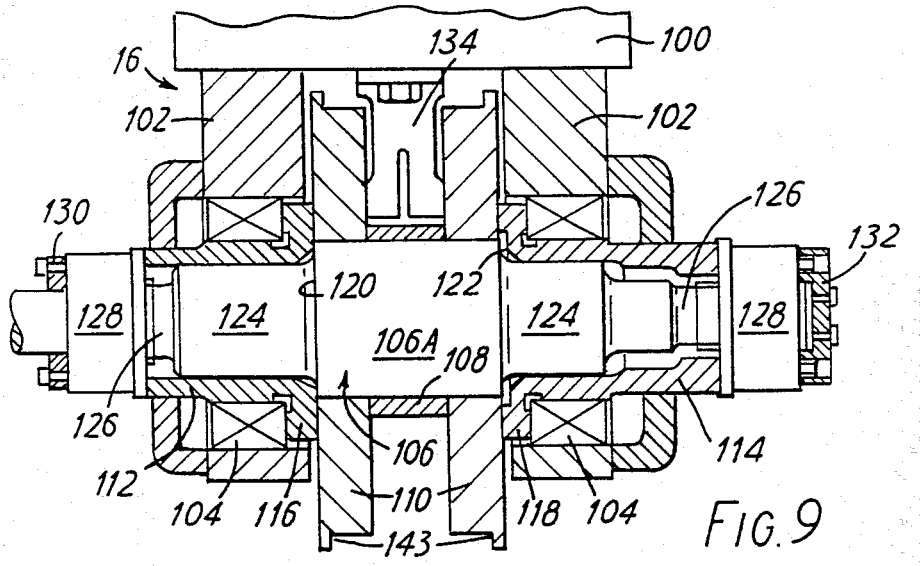
FIG. 9 is a simplified, endwise scrap section, taken on the line IX—IX in FIG. 6 and illustrating the mounting of a mandrel support roll assembly of the machine.

The rotatable assembly is best seen in FIG. 9. It comprises a mandrel support roll shaft 106 having a central cylindrical portion 106A of enlarged diameter, and a pair of mandrel support rolls 110 which are journalled on the central shaft portion 106A. The rolls 110 are axially movable on the latter independently of each other, but their axial spacing is limited by a spacing sleeve 108 around the portion 106A. The support roll shaft 106 is surrounded, outwardly of the central portion 106A, by a pair of bearing sleeves 112, 114 having respective opposed flanges 116, 118. The flange 116 of the rear bearing sleeve 112 has an end face abutting axially against the rear shoulder 120 of the enlarged central shaft portion 106A, whilst the flange 118 of the front bearing sleeve 114 has an annular rebate 122 of greater diameter than the shaft portion 106A. The opposed end faces of the flanges 116, 118, including that within the rebate 122, are planar.

It should be noted that the other, or outwardly-facing, faces of the bearing sleeve flanges 116, 118 are in axial engagement with the bearings 104, the bearing sleeves having cylindrical portions 124 which are mounted directly in the bearings, and the arrangement being such as provide a limited degree of axial float of the bearing sleeves 112 and 114 with respect to the shaft 106 and with respect also to the yoke plates 102.

Beyond the cylindrical portions 104 are a pair of trunnions 126 of the shaft 106. The trunnions 126 are provided with screw threaded portions, upon each of which there is mounted a shaft tensioning device 128. In this example, the tensioning devices 128 are tensioning nuts of the type marketed under the Trade Mark PILGRIM, and referred to hereinafter as "Pilgrim nuts". The Pilgrim nuts are applied to the shaft by hydraulic means (not shown) so that they are fixed to the shaft 106 in predetermined axial positions (in which they are then secured by securing devices 130, 132) in such a way that the shaft 106 is pre-tensioned, i.e. maintained in continuous axial tension. Each Pilgrim nut abuts against the outer end of the adjacent bearing sleeve 112 or 114. Thus the bearing sleeves 112 and 114, mandrel support rolls 110 and spacer sleeve 108 are normally held in axial compression; the whole rotatable assembly can thus float axially in the yoke plates 102. This allows the rolls 110 to be re-ground and then re-mounted without the need for separately realigning them.

Fixed to the underside of the thrust block 100 are locating blocks 134 which locate the opposed inner faces of the mandrel support sleeves 110 so as to position the latter axially and so centralise the rotatable assembly of the moving head 16 with that of the fixed head 14. The locating blocks 134 have a small degree of axial resilience.

A small auxiliary motor 136 (FIG. 5) may optionally be coupled to the mandrel support roll shaft 106 and carried by the yoke, in order to rotate the mandrel support rolls 110 when the machine is initially started. However, these rolls are in normal operation rotated by friction drive through other components deriving power from the main motor 12, as will be seen, so that the assistance of the auxiliary motor 136 is not then required.

Referring to FIG. 12, it will be realised that the moving head 16 is so called because it is adapted to be moved vertically, i.e radially with respect to the die 48 at the working station 32, between a raised position and a range of working positions, the lowest or final one of which is represented by the mandrel support rolls 110 as shown in FIG. 12. Each of the mandrel support rolls 110 has at its outer side a radial mandrel-locating flange 143, which initially engages behind the corresponding one of two radial shoulders formed on the mandrel 50, so as to centralise the latter axially.

The fixed head assembly 14 is so called because it is not arranged for vertical movement. It comprises a pair of die support rolls 138 which are mounted upon a central cylindrical portion 141 (of enlarged diameter) of a die support roll shaft 140, FIGS. 11 and 12. The central shaft portion 141 is surrounded by the die drive roll 78 (see FIG. 12). The shaft 142 is furnished with a pair of opposed shaft sleeves 112 and 114, and is pre-tensioned by a pair of Pilgrim nuts 128, in the same manner as is the mandrel support roll shaft 106. The shaft 138 is driven by the main motor 12 through any suitable transmission, represented in FIGS. 5, 6 and 10 at 142.

Figure 7:
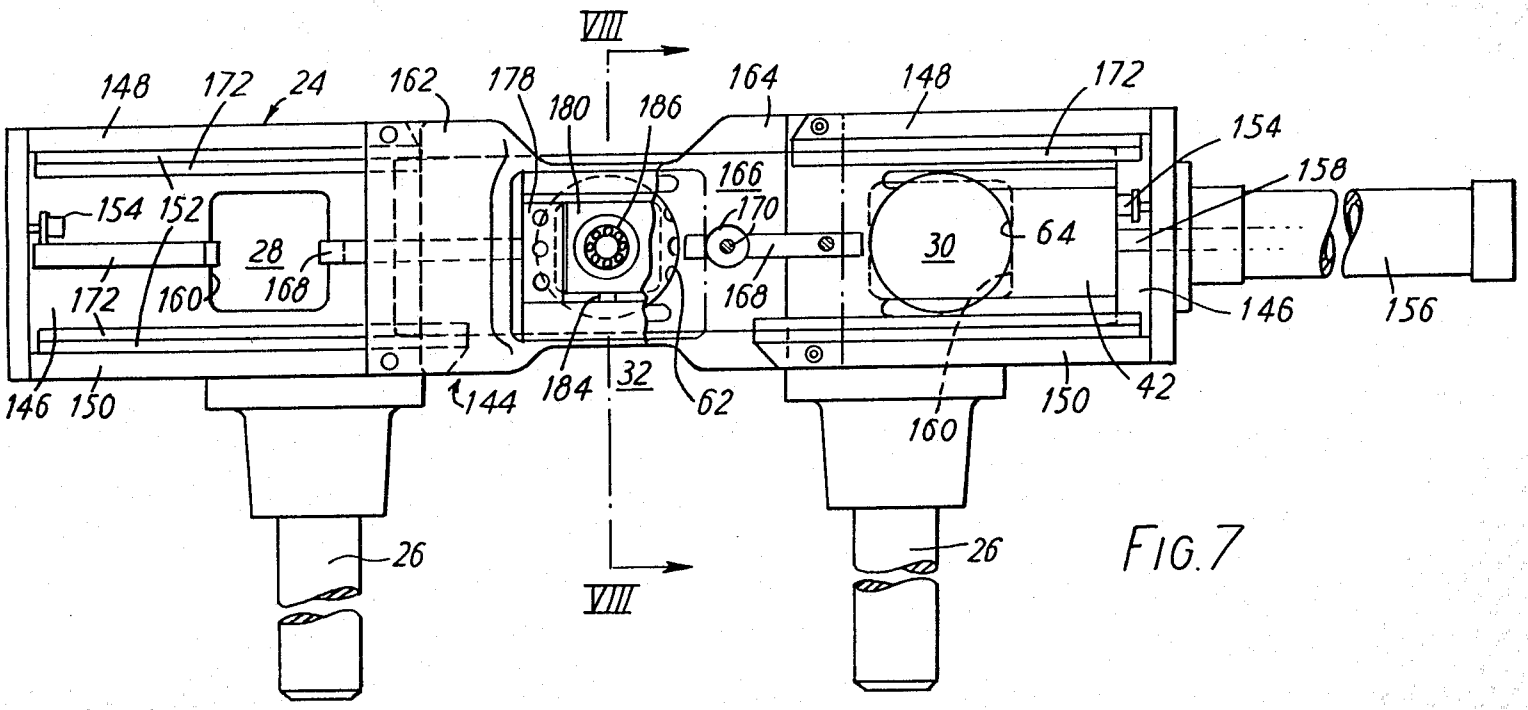
FIG. 7 is a simplified front elevation of a shuttle housing which is part of the same machine.

The transfer assembly 22 will now be described in greater detail, starting with those parts of it shown more particularly in FIGS. 7, 8 and 10.

The shuttle housing 24 comprises a central, hollow body 144 to which is secured a rear housing plate 146 which extends horizontally from the body 144. Each housing plate 146 carries a cover plate 148 and a base plate 150, each of which is furnished with longitudinal guide bars 152 which serve as tracks for longitudinal movement of the shuttle 42, and which also locate the shuttle vertically. At each end of the shuttle housing is an end plate carrying an end stop 154 for the shuttle movement. One of these end plates carries a double-acting hydraulic actuator 156 whose ram 158 is attached to the proximal end of the shuttle 42 and which serves to effect the reciprocatory movement of the latter between the three stations 28, 30, 32. At each of the transfer stations 28 and 30, the appropriate rear housing plate 146 has a through hole 160, which, when the corresponding die aperture of the shuttle is at that transfer station, lies directly behind the die aperture.

The central body 144 may be regarded for present purposes as being constructed from a front housing block 162 and a rear housing block 164, the housing blocks being appropriately secured together and to the various plates 146, 148, 150 to form a rigid unit. The housing blocks 162 and 164 define between them a working chamber 166, FIG. 8, which is open on all sides except the front and rear. In FIG. 7, the front housing block 162 is shown partly cut away (the cut-away part being represented in outline by phantom lines), to show one of two front guide bars 168 secured to an inner face of the block 162 by means of rearwardly-projecting spacers 170, also seen in FIG. 8. These guide bars 168, together with front and rear guide bars 172 (carried variously by the rear housing plates 146 and top and bottom guide bars 152 as shown in FIG. 8), and a further pair of rear guide bars 168 which can be seen in FIG. 8 and which are carried by the rear housing block 164, serve to locate the shuttle transversely of the shuttle housing 24.

The working chamber 166 is of such dimensions as to accommodate the mandrel support rolls 110 and die support rolls 138, in the straddling relationship with the shuttle 42 that is seen in FIG. 12. The body of the shuttle is shown in FIGS. 7 and 8, but for clarity no part of either the fixed head assembly 14 or the moving head 16 is shown in these Figures. The die housing and die are also omitted for the same reason, but in FIG. 8 the mandrel 50 is indicated by phantom lines in the position to which it is initially inserted prior to the commencement of a ring rolling operation.

The front and rear housing blocks 162, 164 have respective forwardly and rearwardly projecting portions 174, 176 each having a generally-rectangular through aperture, at each end of which there are fixed a pair of sliding guide bars 178. Mounted in each of these apertures, and slidable vertically between the guide bars 178, is a mandrel carrier. The front and rear mandrel carriers are denoted by the reference numerals 180 and 182 respectively. Each mandrel carrier is so shaped as to be located in all horizontal directions by the guide bars 178, its vertical downward movement being resiliently biassed upwardly. In this example this biassing is obtained by loading a pair of return pistons 184 by hydraulic pressure.

Figure 8:
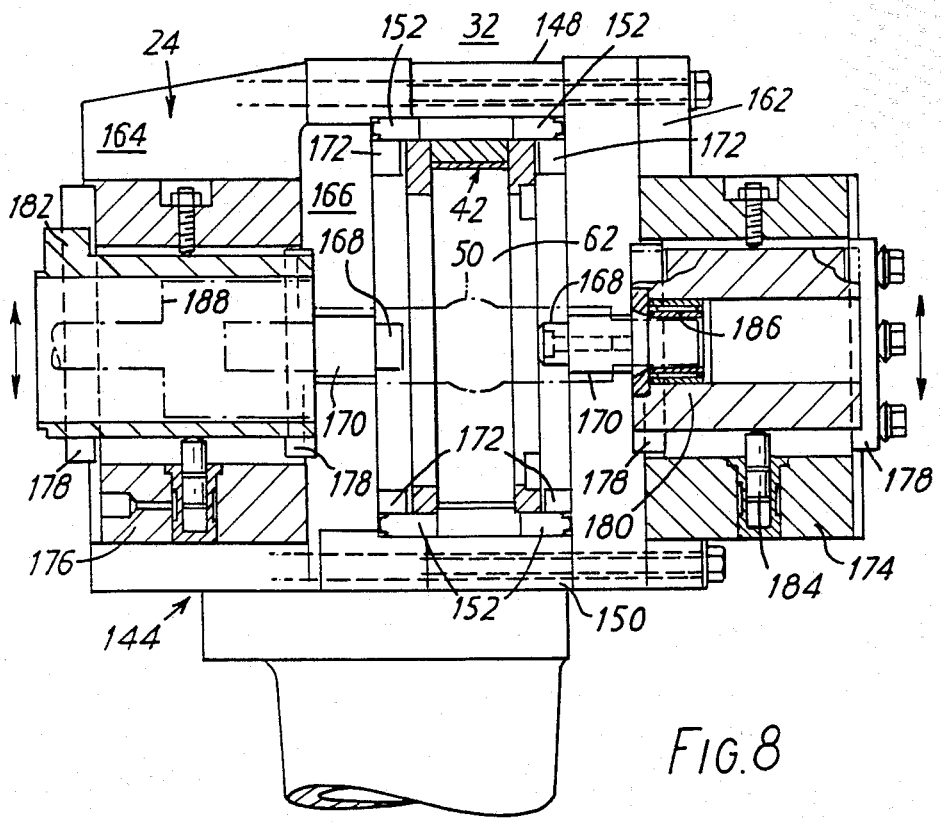
FIG. 8 is a simplified sectional endwise elevation taken on the line VIII—VIII in FIG. 7.

The front mandrel carrier 180 has a front mandrel bearing 186, whilst the rear mandrel carrier 182 has a cylindrical bore, open at both ends, in which a rear bearing carrier, indicated in FIG. 8 by phantom lines at 188, is axially slidable. The rearward end portion 190, FIG. 12, of the mandrel, is held rotatably by the rear carrier 188, which is coupled to an actuator 192 (FIG. 10) whose function is to advance the mandrel into the working position indicated in FIG. 8, prior to the commencement of each ring rolling operation, and to withdraw it behind, and clear of, the shuttle 42 after such operation so that the shuttle can be moved longitudinally. The actuator 192 is secured, by means not shown, to the rear end of the rear mandrel carrier 182, so that when the mandrel is in its working position, the whole assembly of actuator 192, mandrel carriers 180, 182 and the mandrel itself, can move vertically against the return pistons 184.

There remain to be described the die insert loaders 34 and the blank loaders 36, FIGS. 5 and 6. The two die insert loaders are of identical construction to each other, and only one of them will therefore be described.

Figure 13:
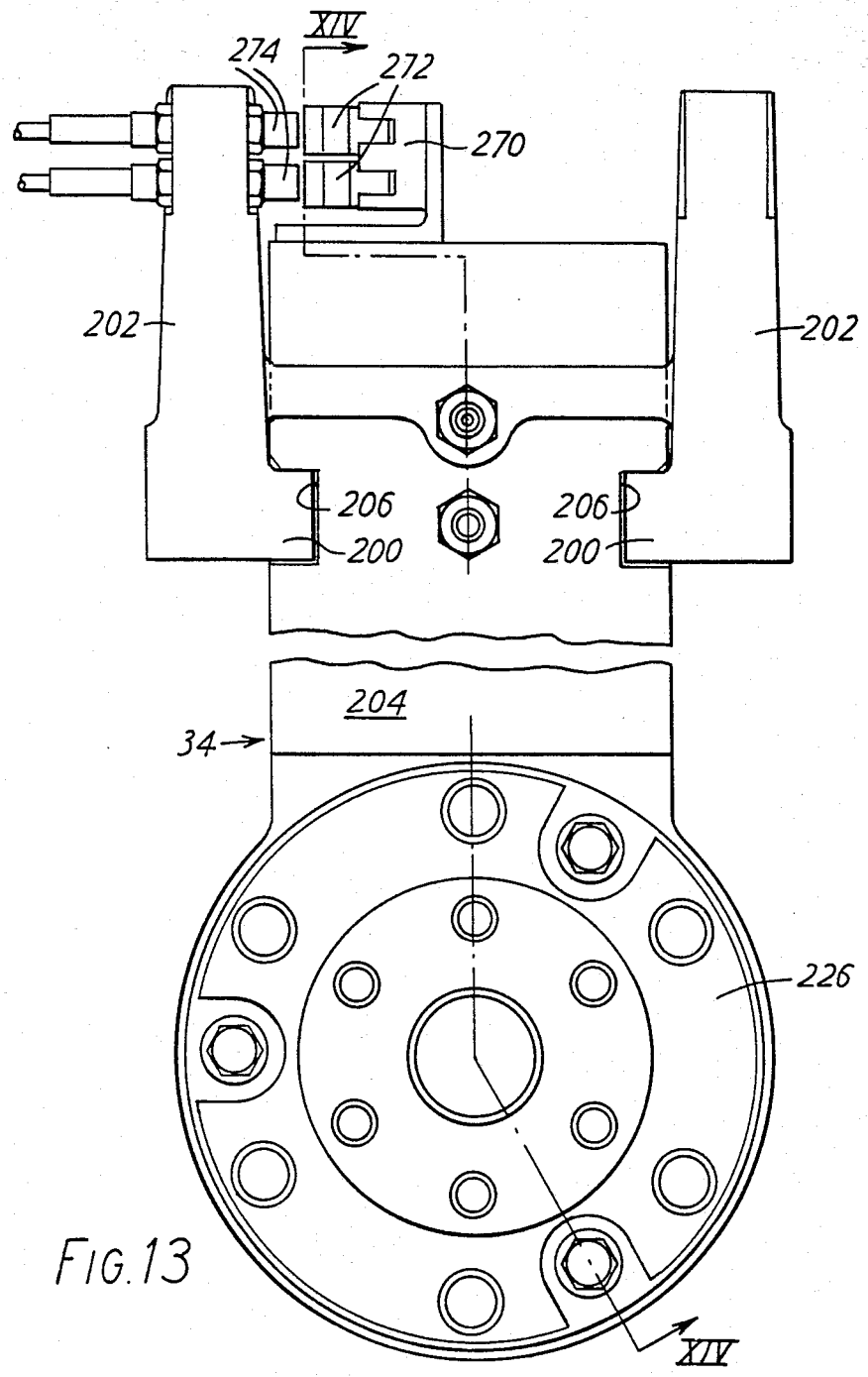
FIG. 13 is a greatly simplified elevation, seen from the front of the machine, showing a die insert loader which is one of two such loaders forming part of the machine.
Figures 14, 15:
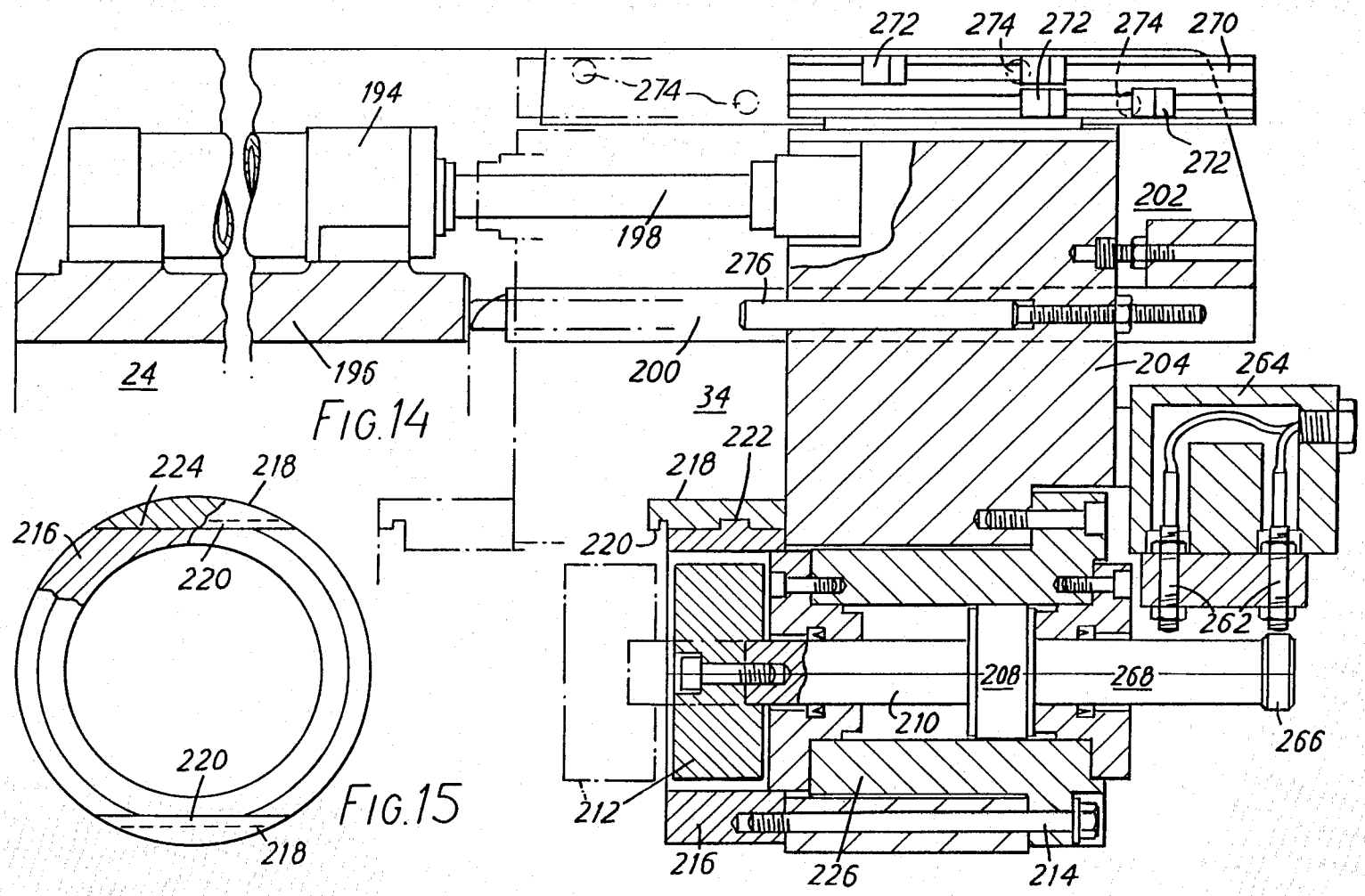
FIG. 14 is a greatly-simplified sectional elevation of the same die insert loader, taken on the line XIV—XIV in FIG. 13.
FIG. 15 is an exterior end view of a die insert claw and sleeve of the die insert loader, as seen from the left-hand side of FIG. 14.

Referring now, accordingly, to FIGS. 13 to 15, the die insert loader includes a double-acting hydraulic actuator 194 of the piston-and-cylinder type, which is mounted on a base plate 196 secured rigidly on the top of the shuttle housing 24. The axis of the ram 198 of the actuator 194 is co-planar with, and above, the axis 66 or 68 of the shuttle aperture 62 or 64 respectively (see FIG. 10) when the shuttle aperture is at the particular transfer station 28 or 30, FIG. 6, at which the die insert loader under consideration is mounted. The base plate 196 is part of a rigid structure which includes a pair of opposed slide bars 200, extending forwards from in front of the top of the shuttle housing 24, FIG. 14. The guide bars 200 are joined to the base plate 196 by a pair of parallel, upstanding cantilever ribs 202.

The remainder of the die insert loader consists substantially of a loading head which is reciprocable towards and away from the shuttle housing 24 by the hydraulic actuator 194. The loading head includes a crosshead 204, having parallel side grooves 206 by which the crosshead is suspended from, and slidable transversely of the shuttle housing along, the slide bars 200. The crosshead 204 has fixed in a cylindrical hole through its lower part a hydraulic clamp nose actuator cylinder 226 whose axis is coincident with the appropriate axis 66 or 68 (FIG. 10). A double-acting piston 208 is slidable in the cylinder 226, and carries a coaxial ram 210 which extends towards the shuttle housing. The rearward end of the ram 210, i.e. the end nearest the shuttle housing, has fixed to it a cylindrical clamp nose 212.

To the rear side of the crosshead 204 there is fixed, by means of bolts 214, an annular die insert claw sleeve 216 which extends towards the shuttle housing and which is coaxial with the clamp nose 212 and ram 210. The die insert claw sleeve 216 has a pair of parallel flat portions formed in its outer cylindrical surface. A pair of opposed claw members 218 are mounted on these respective flat portions 224 and extend axially beyond the claw sleeve 216 to present a pair of chordal claw elements 220, whose function is to engage in the annular groove 92, FIG. 12, of the corresponding front die insert 82, for the purpose of gripping the latter, as will be seen later herein when the operation of the die insert loader will be described. Transverse retaining ribs 222 are provided across the flat portions 224, to provide axial location of the claw members 218 on their sleeve 216, and the claw members are secured radially to the sleeve by suitable means, not shown.

The die insert claw head at the right-hand transfer station 30, is indicated in FIG. 10, though not that at the left-hand transfer station 28. Each die insert claw head comprises the assembly of claw sleeve 216 and claw members 218. The clamp noses 212 at both transfer stations are indicated in FIG. 10.

From FIG. 14, it will be seen that the actuator 194 serves to reciprocate the die insert claw head 216, 218 between its normal or advanced position indicated in phantom lines, and a retracted position shown in full lines. In the advanced position the claw elements 220 are aligned with the die insert groove 92 of the die in the corresponding shuttle aperture 62 or 64 (FIG. 10). In order to accommodate the claw elements in this position as the shuttle moves towards and away from the transfer station, a pair of horizontal grooves (seen best in FIG. 10) is provided at each end of the shuttle side plate 60. These grooves extend from the corresponding end of the shuttle to intersect the aperture 62 or 64. By means of the clamp nose actuator 208, 210, 226, the clamp nose 212 is reciprocable between its normal and retracted position, surrounded by the claw sleeve 216, and an advanced position relative to the claw sleeve, this relative advanced position being indicated by phantom lines in FIG. 14.

Turning now to FIGS. 6 and 16, the two blank loaders 36 are substantially identical with each other except that they are "handed" as indicated in FIG. 6. The one now to be described is the right-hand blank holder illustrated in FIG. 16, from which it can be seen that the annular blanks 2 are presented one at a time by the blank loader into the loading position indicated in phantom lines, in which the axis of the blank 2 is coincident with the axis 68 of the shuttle aperture (and of the die inserts). The blank is moved to this position, along an upwardly inclined path indicated by the arrow 228 in FIG. 16, by a cradle portion 230 of a carrier member 232. The carrier member 232 is slidable along a suitable guide and support frame 234 which is fixed to a backplate assembly indicated at 236. The backplate assembly is secured, by means not shown, to the front of the shuttle housing 24, FIG. 6. The carrier member 232 is reciprocated along the frame 234 by a double-acting hydraulic actuator 238 carried by the backplate assembly 236, and carries a pusher 240 to which there is secured a pull rod 242. The pull rod 242 is secured to a pin 244 which is rotatable in a boss 246. The boss 246 is part of a blank-retaining finger 248, and is offset from a pivot 250 by which the finger 248 is carried by the backplate assembly 236. Thus movement of the pull rod 242, as the carrier member 232 is advanced, causes the blank-retaining finger 248 to rotate from its normal position, indicated in full lines, to a blank-engaging position indicated in phantom lines. The pull rod is attached to a tension spring 252 which assists the finger 248 to exert a positive radial force upon the blank 2, the finger thus being held, when in its normal position, by the actuator 238 against the force of the spring 252.

In its retracted position, as shown, the cradle portion 230 lies in line with a feed magazine 254 along which the blanks 2 are guided by gravity in linear succession. A shoulder 256 of the carrier member 232 prevents each blank from advancing until the cradle portion 230 returns to its retracted position after having delivered the preceding blank to its loading position.

It will be seen that because of the upward inclination of the direction of feed indicated by the arrow 228, the cradle portion 230 and blank-retaining finger 248 cooperate to hold the blank with a tripod support whereby the blank is automatically located accurately for the subsequent operation (to be described hereinafter), which is the loading of the blank into the shuttle. During its travel in the direction of the arrow 228, the blank is retained laterally by fixed side guides 258.

In FIG. 10, the cradle portion 230 and blank-retaining finger 248 of the right-hand blank loader are indicated, and from this it can be seen that the path 228 of travel of the cradle portion intersects the space between the front of the shuttle and the rear or claw-carrying end of the claw head 212, 218 of the corresponding die insert loader.

Reverting to FIGS. 5 and 10, it will be remembered that, besides a blank loader and a die insert loader, there is also provided at each of the two transfer stations 28, 30 an ejector unit 38. This consists of a double-acting hydraulic actuator, seen in FIG. 5, carrying an ejector nose 260 (FIG. 10), whose axis is coincident with the appropriate shuttle aperture axis 62 or 68 when the shuttle is at the station concerned, and which is thus transversely opposed to the clamp nose 212 of the corresponding die insert loader, FIG. 14. The actuator of each ejector unit is fixed to the corresponding rear housing plate 146 of the shuttle housing, FIG. 7.

The sequence of operation of the machine is controlled by an automatic control system, which is not shown in detail in the drawings and which can take any form suitable for performing the operations described herein. In particular, the required operating sequence of the various hydraulic actuators is conveniently controlled by an electro-hydraulic system whereby fluid control valves in the hydraulic supply system of the actuators are themselves actuated in response to appropriate electrical signals from a number of proximity sensors and limit switches. Thus, for example, limit switches in the end stops 154, FIG. 7, indicate that the shuttle is at the end of its travel with the appropriate shuttle aperture aligned with the ejector nose 260 and clamp nose 212 at the adjacent transfer station. By way of example, FIGS. 13 and 14 illustrate certain proximity sensors associated with the die insert loader shown in those Figures. Thus, in FIG. 14 (but omitted from FIG. 13), a pair of proximity sensors 262 are carried in a housing 264 fixed to the front of the crosshead 204. These sensors 262 are arranged to detect the presence of a flange 266 formed on a forward extension 268 of the clamp nose actuator ram 210, at each end of the stroke of the latter. Similarly, the crosshead 204 carries a longitudinal frame 270 to which are fixed four dogs 272. The presence of these is detected, at the appropriate stages in the travel of the crosshead under control of the actuator 194, by proximity sensors 274 mounted in the cantilever ribs 202.

It will be noticed that the frame 270 is provided with longitudinal dog-carrying grooves, whereby the position of each of the dogs 272 can be accurately adjusted, in conjunction with a stop bar 276 carried by the cross-head for engagement with the front end face of the base plate 196. In this way setting of the stroke and timing of the operation of the die insert loader can be achieved accurately, quickly and easily. It will therefore be seen that the same principles can be applied to other components of the ring rolling machine, for example the moving head ram unit 18, shuttle actuator 156, blank loader 36, mandrel actuator 192 and ejector units 18.

Figure 18:
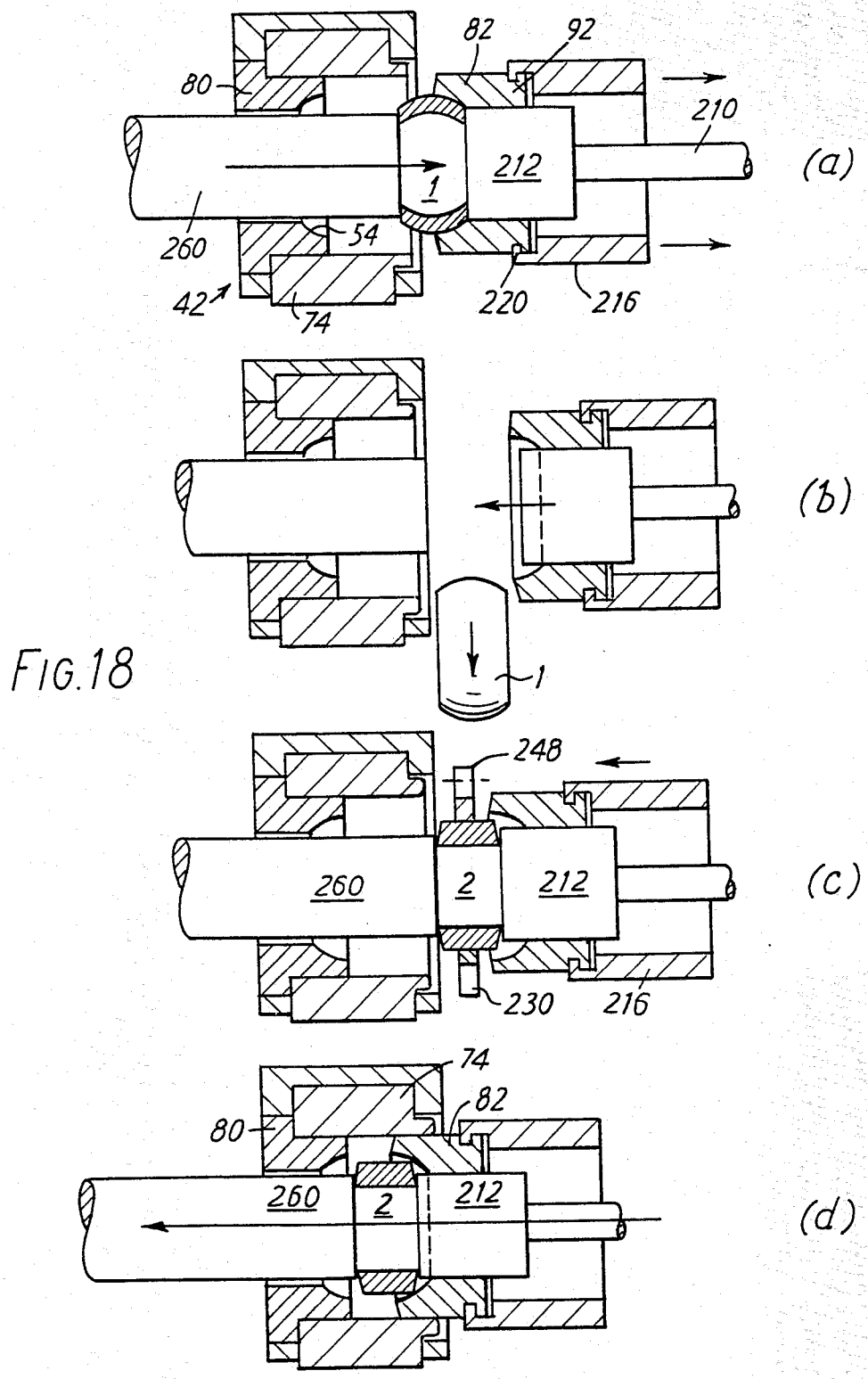
FIG. 18 is in four diagrammatic parts, viz (a) to (d), each of which illustrates a stage in the sequence of the process of unloading die insert with a rolled cage ring from the machine, loading a fresh cylindrical blank in its place, and re-inserting the die insert.

The operation of the machine will now be described, in terms of, first, the ring rolling operation itself and then the sequence of operations at the transfer stations. Reference is made in particular to FIGS. 12, 17 and 18, and the diagrammatic nature of these Figures, particularly FIG. 17, must be emphasised.

Referring to FIG. 17(*a*), when the shuttle 42, carrying die inserts 80, 82 and a fresh blank 1, has been moved to the working station, the mandrel 50 (with its rear mandrel bearing carrier 188) is in its retracted position, to the rear of the shuttle, and the mandrel support rolls are in their raised position (indicated, in respect of the lower edge of these rolls, by phantom lines). The other components indicated in FIG. 17(*a*), namely the front mandrel bearing carrier 180, die support rolls 138 and die drive roll 78, are in the positions indicated by full lines; this is also true of the die inserts 80, 82, which lie in contact with each other along the midplane of the die profile 54 and with their outer faces 86 and 88 out of axial contact with the mandrel support rolls 110 and die support rolls 138.

As soon as the shuttle has come to rest, the mandrel is inserted through the die and the workpiece 1 so that its free end is rotatably supported in the front mandrel carrier 180 in the manner already described. The moving head 16 is now lowered. At the instant before contact of the mandrel support rolls 110 with the mandrel, all components are as shown in full lines in FIG. 17(*a*), the mandrel being centered by the flanges 143; at the same time the support rolls 110 start to push the mandrel downwards against the resistance of the hydraulically loaded return pistons 184 (FIG. 8). This movement continues until the mandrel reaches the position indicated by phantom lines in FIG. 17(*a*), i.e. when the mandrel profile just comes into radial contact with the bore of the workpiece 1. This is a critical point in the process, and will be referred to as the "instant of initial load", because this is when the radial load commences to be applied by the moving head 16 to the workpiece and associated components of the machine.

Several events take place simultaneously at the instant of initial load. Firstly, the downward load on the workpiece is transmitted by the latter to the die inserts 80 and 82. Because this force has axial components towards both the front and the rear, the die inserts are thereby forced axially apart by a very small amount, so that their planar outer faces 86 and 88 bear hard against the inner faces of the mandrel support rolls 110 and also against those of the die suport rolls 138. Secondly, radial reaction forces between the mandrel and the mandrel support rolls are equalised so that the axis of the mandrel is to all intents and purposes parallel with (but below) the die axis 52. In addition, the workpiece is now instantaneously located by tripod support, i.e. at the point of contact of the mandrel with the workpiece, and at two points of contact between the latter and the respective die inserts. This has the effect that the workpiece is set upright, that is to say with its axis truly parallel with those of the die and mandrel. In other words the workpiece and tools are now accurately positioned for the rolling process now commencing.

The third event that takes place at the instant of initial load is that the die housing 74, projecting below the shuttle as explained above with reference to FIG. 11, is forced radially against the rotating die drive roll 78. Consequently, because the die drive roll, the die housing, the die inserts, the workpiece and the support rolls 110 and 138 are all now variously in contact with each other, being stressed by appropriate components of force deriving from the downward force applied through the moving head 16, movement of any one of these is transmitted to the component or components so engaging it. Therefore, rotation of the die drive roll 78 causes the die housing 74 and die inserts 80 and 82 to rotate about the axis 52, whilst also forcing the workpiece and mandrel to rotate about their respective axes. The mandrel, in turn, rotates the mandrel support rolls 110. It is important here to notice that the die drive roll 78, besides providing the positive driving force to the die, also takes the whole of the radial reaction force from the ring rolling process.

The configuration of the various machine components at the instant of initial load, just described above, is again represented in FIG. 17(*b*), this time in full lines. FIG. 17(*b*) represents the actual ring rolling operation. As the moving head 16 continues to descend, the resulting increased downward pressure causes the mandrel to form an initial depression (indicated at 278 in FIG. 17(*b*)) in the bore of the workpiece.

As a result of a very small outward deflection, indicated in phantom lines in FIG. 17(*b*), of the mandrel support rolls 110, the mandrel can now "float" axially by a small amount. This has the advantage that the mandrel now tends to be centred continuously in the depression it has already made in the workpiece bore.

The downward pressure from the moving head 16 is now maintained for a predetermined number of revolutions of the die drive roll 78. During this phase of the operation, the deformation of the workpiece to the form shown in FIGS. 1, 2 and 12 is completed, the moving head and mandrel being allowed to move further downwards as necessary to conform with the profile of the workpiece as the latter is modified.

The configuration is now as shown in FIG. 12. It should be noted here that, in spite of the fact that the die inserts 80 and 82 have undergone some slight axial separation, the magnitude of the axial gap between them, at the profiled surface 54 of the die, is (like that of the axial deflection of the mandrel support rolls 110 and an accompanying similar deflection of the die support rolls 138) too small to be clearly shown except with great exaggeration as in FIG. 17. In FIG. 12 the said gap and deflections are accordingly not visible.

Referring still to FIG. 12, the final centre line of the mandrel 50 is there indicated at 280. With the die drive roll 78 and die support rolls 138 continuing to rotate, and continuing to cause the various associated tool components and the workpiece to rotate, the moving head 16 commences its upward retracting movement. This reduces the downward applied force on the mandrel, so increasing the velocity of rotation; whilst at the same time the mandrel begins to move upwardly under the influence of the hydraulic pressure behind the return pistons 184 (FIG. 8) as the mandrel support rolls 110 move upwardly. The only substantial linear forces acting on the die inserts are now the opposed axial forces resulting from the pre-tensioning of the shafts 106 and 140 and transmitted through the support rolls 138 and 110, so that the axial deflections of the support rolls and die inserts become relieved.

When the mandrel, now no longer rotating, has risen to the position at which its axis is once again coincident with the die access 52, the mandrel actuator 192 is operated to retract the mandrel behind, and clear of, the shuttle 42.

The shuttle is now moved from the working station 32, FIG. 6, to the appropriate one of the transfer stations 28, 30. This also disengages the die housing 74 from the die drive roll 78, and the die inserts from the support rolls 110 and 138, so that the die housing 74 and the rolls 110 cease to rotate; the die inserts 80, 82 and the workpiece 1 accordingly, during their transfer to the transfer station, lie stationary in the die housing and are substantially unstressed and free to "float" axially. As previously explained, during the movement of the shuttle the claw head 216,218 is in its normal or advanced position, with the claw elements 220 aligned with the die insert groove 92. Thus as the die insert arrives at the transfer station, the walls of the groove 92 become slidingly engaged with the claw elements, so that the latter then grip the die insert.

Referring now to FIG. 18, upon arrival of the workpiece 1 at the transfer station, the clamp nose 212 and ejector nose 260 are advanced towards the shuttle, so that the workpiece becomes trapped between them. The clamp nose 212 and claw sleeve 216 are now retracted whilst the ejector nose 260 continues to advance.

The clamp nose has a diameter such that it fits snugly, but is easily slidable axially, in the bore of the front die insert; accordingly the latter is both supported by the clamp nose and located diametrally by it with its axis correctly orientated. In this manner, the front die insert 82 and workpiece 1 are removed together from the shuttle, as shown in FIG. 18(*a*). The clamp nose 212 ensures that the workpiece is stripped from the profiled surface of the front die insert, which now serves merely to locate the workpiece. Thus, when as now happens, the forward movement of the ejector nose 260 is halted whilst retracting movement of the claw sleeve, still carrying the die insert, is continued (as shown in FIG. 18(*b*)), the workpiece 1 is released. The workpiece falls away to be conveyed along the appropriate delivery runway 44 or 46, FIG. 6.

Any residual circumferential "flash", (which may be present in certain cases) is subsequently removed from the workpiece by one of two methods, depending on the configuration of the workpiece. In the case of a workpiece in the form of a ring having a spherical outer surface such as the cage ring 1, a suitable de-flashing device (not shown in the drawings) is arranged in, or downstream of, the delivery runways. Where the outer surface of the ring is cylindrical, the "flash" is more conveniently removed by a conventional centreless grinding operation.

Returning to the transfer station, the blank loader, the cradle portion 230 of whose carrier member, and whose blank-engaging finger 248, are indicated in FIG. 18(*c*), advances a fresh blank 2 into the space between the rear of the front die insert 92 and the ejector nose 260 whilst the two last-mentioned components are in their fully-retracted and fully-advanced positions, respectively, as represented in FIG. 18(*b*). The clamp nose 212 is now advanced until its leading face engages the blank 2 and pushes the latter towards the ejector nose 260. The blank is now clamped between the two noses 212 and 260, whereupon the finger 248 and cradle portion 230 are retracted by the die loader. As shown in FIG. 18(*c*), the claw sleeve 216 is now advanced towards the shuttle, so that the front die insert 82 rides along the clamp nose 212 by a small amount so as to bring the front end of the blank 2 within the profiled portion of the die insert. Advance of the claw sleeve is now continued, but with relative movement as between the claw sleeve and the clamp nose 212 halted, so that the latter now commences to push the blank into the shuttle. The ejector nose 260, still in clamping engagement with the blank 2, is allowed to retract under the axial force exerted by the die insert loader through the clamp nose 212 and blank 2.

FIG. 18(*d*) shows a subsequent stage in which the front die insert has entered the die housing 74. When, finally, the front die insert makes axial contact with the rear die insert 80, the advancing movement of the claw sleeve 216 is halted, but the ejector nose 260 continues to be retracted clear of the shuttle. The clamp nose 212 is retracted, the claw sleeve 216 now being once more in its normal or advanced position.

The die 48 is thus now assembled in the shuttle 42 with its fresh workpiece in position ready to be transferred, by longitudinal movement of the shuttle (thus disengaging the claw elements 220 from the die insert 82), to the working station 32.

I claim:

1. Apparatus for forming rings to a predetermined profile from a succession of annular blanks by cold rolling the blank, the apparatus being of the kind having an annular die, a mandrel for cooperating with the annular die, die drive means for rotating the die about the axis of the die, and force-applying means for applying a radial force to the mandrel when the mandrel extends through the die with the annular blank surrounding the mandrel and surrounded by the die, so as to squeeze the blank along an axial cross-section thereof to one side of the axis of the blank but not the other, said mandrel, die drive means and force-applying means being situated at, and defining, a working station of the apparatus, the apparatus comprising means for rotating the mandrel whereby the said radial force causes the section of the blank so squeezed to be deformed to conform with an internal profile of the die and an external profile of the mandrel, the apparatus further comprising means defining at least one transfer station remote from the working station, for removal of the rolled ring and insertion of a fresh blank, and a shuttle having a through opening for accommodating the die, means for moving the shuttle so as to transfer the through opening between the working station and said at least one transfer station, the shuttle comprising means for so mounting the die as to cause the die drive means to be in operative engagement with the die when the latter is at the working station.

2. Apparatus according to claim 1, comprising an annular die housing mounted rotatably in the through opening whereby the latter constitutes the female element of a bearing, the through opening being in the form of an incomplete circle to define a slot in one face of the shuttle through which the die housing projects to engage the die drive means.

3. Apparatus according to claim 1 or claim 2, comprising means to reciprocate along a straight path between the said stations.

4. Apparatus according to claim 1 or claim 2, having a first and a second said transfer station, the working station being midway between the transfer stations and the shuttle having a first and a second said through opening, so spaced apart that when the first opening is at the first transfer station the second opening is at the working station, the shuttle being arranged to move the first opening between the first transfer station and the working station whilst moving the second opening between the second transfer station and the working station.

5. Apparatus according to claim 2, wherein the die drive means comprises a simple drive roller for direct engagement with the portion of the die housing projecting through the slot in the shuttle, the axes of die drive roller, the mandrel and the through opening at the working station lying in a common plane and the force-applying means being arranged to apply the said radial force to the mandrel in the same plane.

6. Apparatus according to claim 1, wherein the force-applying means comprises a head including a pair of mandrel support rolls, axially spaced apart on a common axis and mounted in a force-transmitting housing of the head, the head being reciprocable in a plane containing the mandrel axis so that the mandrel support rolls transmit the radial force directly to the mandrel itself.

7. Apparatus according to claim 6, wherein each mandrel support roll has a circumferential mandrel-engaging surface and a flange having a flank for axially engaging a corresponding flank of the mandrel, whereby the support rolls together effect axial location of the mandrel.

8. Apparatus according to claim 6, wherein each mandrel support roll has a flank portion for axially engaging a corresponding end face of the die, whereby to effect positive axial location of the die in the through opening of the shuttle.

9. Apparatus according to claim 6, wherein the head comprises a support roll shaft, mandrel support rolls being mounted in common on said shaft, the head further comprising means for maintaining the shaft in tension and for transmitting a resultant compressive, axial reactive force to the support rolls whereby to tend to maintain the axial spacing between the two support rolls at a pedetermined value.

10. Apparatus according to claim 9, wherein the mandrel support roll are mounted on their shaft for limited axial movement away from each other against the axial reactive force.

11. Apparatus according to claim 9 or claim 10, wherein the head further comprises spacer means for limiting to a predetermined minimum value the axial spacing between the mandrel support rolls.

12. Apparatus according to claim 1, wherein the die is a split die comprising a front die insert and a rear die insert.

13. Apparatus according to claim 2, wherein the die comprises a removable die member, there being provided at the (or each) transfer station an ejector device for ejecting the removable die member from the through opening in the shuttle together with a rolled shuttle together with a rolled ring carried therein, and a loader for reinserting the removable die member into the shuttle with a fresh annular blank.

14. Apparatus according to claim 13, wherein the die is a split die comprising a front die insert which constitutes the said removable die member, and a rear die insert.

15. Apparatus according to claim 13 or claim 14, wherein the (or each) loader comprises a die loading head and means for reciprocating the die loading head into and out of the through aperture in the shuttle at the transfer station, there being provided in association with the loader a blank loading or feeding device comprising a blank-holding feed member for presenting each annular blank in succession to a position between the die loading head and the through aperture, so that the die loading head head, carrying the removable die member towards the shuttle, causes the blank to become trapped between the removable die member and the ejector device, whereby the blank is maintained in controlled movement at all times until in position within the shuttle.

16. Apparatus according to claim 1, in which the mandrel is a unitary mandrel the apparatus comprising further: mandrel feed means carrying one end of the mandrel, for inserting the mandrel into the through aperture of the shuttle at the working station; a mandrel bearing, the other end of the mandrel constituting the withdrawable male element of said mandrel bearing, the latter having a female element; and means mounting said female element resiliently so as to be movable in the plane containing the axis of the mandrel in which radial force is applied to the mandrel by the force-applying means.

17. A method for forming rings to a predetermined profile from a succession of annular blanks by cold rolling, the method comprising squeezing an axial cross-section of the annular blank, to one side of the axis of the blank but not the other, between the rotating mandrel and a rotating annular die, with the mandrel extending through the die so that the blank surrounds the mandrel and is surrounded by the die, the squeezing of the said section of the blank being effected by applying an appropriate radial force to the mandrel whereby the squeezed section is deformed to conform with an internal profile of the die and an external profile of the mandrel, said method further comprising the steps loading the annular blank into a shuttle at a transfer station; moving the shuttle so as to bring the blank, carried within the die which is itself mounted within the shuttle, to a working station remote from the transfer station; rotating the die in the shuttle at the working station with the mandrel extending through the die and blank, whilst the said radial force is applied so as to form the blank into a rolled ring of the required profile; subsequently moving the shuttle so as to carry the rolled ring to a transfer station; the ring is there removed from the shuttle and a fresh annular blank inserted; and moving the shuttle again so as to bring the fresh blank to the working station.

* * * * *